United States Patent [19]

Odom

[11] 4,398,898

[45] Aug. 16, 1983

[54] SHOCK SUB

[75] Inventor: Robert L. Odom, Porter, Tex.

[73] Assignee: Texas Long Life Tool Co., Inc., Porter, Tex.

[21] Appl. No.: 239,442

[22] Filed: Mar. 2, 1981

[51] Int. Cl.[3] ..... E21B 17/07; F16F 9/00

[52] U.S. Cl. ..... 464/20; 175/321; 267/125

[58] Field of Search ..... 464/20, 18, 21, 180, 464/183; 175/299, 321; 267/125, 137, 162

[56] References Cited

U.S. PATENT DOCUMENTS

| | | | |
|---|---|---|---|
| 2,570,577 | 10/1951 | Manion | 464/20 X |
| 2,587,016 | 2/1952 | Watts | 267/162 X |
| 3,463,252 | 8/1969 | Miller et al. | 175/321 X |
| 3,830,082 | 8/1974 | Clauss, Jr. et al. | 464/21 |
| 4,194,582 | 3/1980 | Ostertag | 267/137 X |
| 4,207,756 | 6/1980 | Toelke | 464/20 X |

FOREIGN PATENT DOCUMENTS

| | | | |
|---|---|---|---|
| 2600946 | 1/1976 | Fed. Rep. of Germany | 267/162 |
| 2025490 | 1/1980 | United Kingdom | 175/321 |

*Primary Examiner*—John M. Jillions
*Assistant Examiner*—Daniel P. Stodola
*Attorney, Agent, or Firm*—Neal J. Mosely

[57] ABSTRACT

A novel shock sub is disclosed for use in a drill string for absorbing longitudinal and impact loads. A tubular housing is provided for connection to one part of a drill string and a tubular mandrel extends into the housing for longitudinal sliding movement with an outer end portion for connection to the other part of the drill string. The mandrel and housing define an annular cavity when assembled. The mandrel has two slots, positioned 90° apart circumferentially extending for length of the annular cavity. Annular spring washers positioned in the annular cavity are of a size having a sliding fit on the outside of the mandrel and inside the housing. The spring washers are each corrugated in a wave configuration and with a tab of a size fitting one of the mandrel slots and are placed on the mandrel with alternate ones having tabs fitting in one of the slots and the others having their tabs fitting another mandrel slot. This prevents nesting of the washers and provides a greater spring efficiency in absorbing longitudinal shock. An arrangement of slots and bearings interconnects the mandrel and housing to permit sliding movement and transmit rotary motion while absorbing longitudinal shocks.

6 Claims, 4 Drawing Figures

SHOCK SUB

BACKGROUND OF THE INVENTION

1. Field of the Invention

This invention relates to new and useful improvements in shock subs positioned in the drilling string above the drilling bit to absorb vibrations, shock or impact loading otherwise imparted to the drilling string from the drilling bit during the drilling of wells for the production of crude oil, natural gas, geothermal energy, etc.

2. Brief Description of the Prior Art

Large axial displacement drill string vibrations occur in hard formations when drilling against a non-flat surface, a non-homogeneous (hard-soft) surface or a highly fractured surface. When the drilling is carried out using a conventional tricone bit, the vibration or shock or impact loading is multiplied by a factor of three in frequency and substantial impact and vibratory forces are applied in the drill string which results in early failure of tool joints, drill collars, and other portions of the drill string.

Shock absorbers in the form of shock subs which are generally run immediately above the drill bit in a drill string were first developed more than 40 years ago and have been improved in a variety of features over the years since their original introduction. Crowell U.S. Pat. No. 1,767,350 and Archer U.S. Pat. No. 1,960,688 disclose two of the earliest forms of drill string shock absorbers which utilized an elastomeric sleeve to dampen both axial and torsional vibrations. Other U.S. Patents which disclose significant improvements on shock absorbers utilizing elastomeric springs include the following: Gill et al 2,025,100, Crickmer 2,620,165, Ortloff 2,740,651, Vertson 2,765,147, Regland 2,795,398, 3,033,011, Garrett 3,099,918, Crane 3,156,106, Hughes 3,257,827, Wiggins 3,274,798, Coulter 3,301,009, Hughes 3,306,078, Vertson 3,323,326, Leather et al 3,323,327, Haushalter 2,325,132, Davidescu 3,503,224, Zerb et al 3,660,990, Mason 3,949,150.

Another type of rotary shock absorber or shock sub utilizes a compressible fluid as the shock absorbing medium. U.S. Pat. Nos. illustrating this type of shock absorber include the following: Leathers 3,225,566, Frocks 3,230,740, Harrison 3,350,900, Galle 3,382,936, Galle 3,746,329, Webb 3,998,443.

Still another type of shock absorber utilizes a helical spring as the shock absorbing member, U.S. Pat. Nos. which illustrate this type of shock absorber include the following: Ponti 1,785,559, Reed 2,240,519, Allen 2,712,437, Warren 2,991,635, Blair 3,122,902, Karle 3,963,228.

Still another form of shock absorber utilizes a torsional spring as the shock absorbing member. U.S. Pat. Nos. illustrating this principle include the following: Mullins 3,947,008, Amtsperg 3,939,670, Frocks 3,339,380. Manion 2,570,577 discloses the use of annular disc type plate springs as shock absorbing elements. Salvatori et al 3,383,126 and Falkner 3,406,537 disclose the use of wire mesh springs as the shock absorbing member. Garrett 3,254,508 and Wiggins 3,263,446 disclose the use of a bellows as a shock absorber. Bergstrom 4,211,440; Ostertag 4,194,582; and Aumann 4,186,569 disclose shock subs using various kinds of spring washers. Nixon 4,162,619 discloses a shock sub for absorbing rotary as well as longitudinal shocks.

Ashfield et al 4,043,546 disclose certain novel compression spring washers.

SUMMARY OF THE INVENTION

One of the objects of this invention is to provide a new and improved shock sub for earth drilling which will absorb longitudinal and impact loads in the drill string.

Another object of this invention is to provide a new and improved shock sub having an improved shock absorbing spring.

Still another object of this invention is to provide a new and improved shock sub having an improved shock absorbing spring consisting of a plurality of wave washers which are oriented on a supporting mandrel with the trough of one washer engaging the crest of a wave in an adjacent washer.

Still another object of this invention is to provide a new and improved shock sub which is of simple and inexpensive construction and has long life and resistance to wear.

Other objects of this invention will become apparent from time to time through out the specification and claims as hereinafter related.

These and other objects of this invention are achieved by a new and improved shock sub designed for use in a drill string for absorbing longitudinal and impact loads. This shock sub has a tubular housing for connection to one part of a drill string and a tubular mandrel extending longitudinally into said housing for longitudinal sliding movement therein and having an outer end portion for connection to the other part of the drill string. The mandrel and housing each have a shape defining an annular cavity therebetween when assembled together. The mandrel has two longitudinally extending slots, positioned 90° apart circumferentially thereof, which extend for substantially the entire length of the annular cavity. A plurality of annular spring washers are positioned in the annular cavity which are of a size having a sliding fit on the outside of the mandrel and inside the housing. Each of the spring washers is corrugated in a wave configuration and has an internally extending tab of a size fitting one of the mandrel slots. The spring washers are assembled on the mandrel with alternate ones having their tabs fitting in one of the slots and the others having their tabs fitting another mandrel slot positioned 90° from the first slot, an arrangement which prevents nesting of the washers and provides a greater spring efficiency in absorbing longitudinal shock. An arrangement of slots and bearings interconnects the mandrel and housing permitting longitudinal sliding movement and preventing relative rotary movement so that the sub can transmit rotary drilling motion while functioning to absorb longitudinal shocks.

DESCRIPTION OF THE PREFERRED EMBODIMENT

Figure 1A:
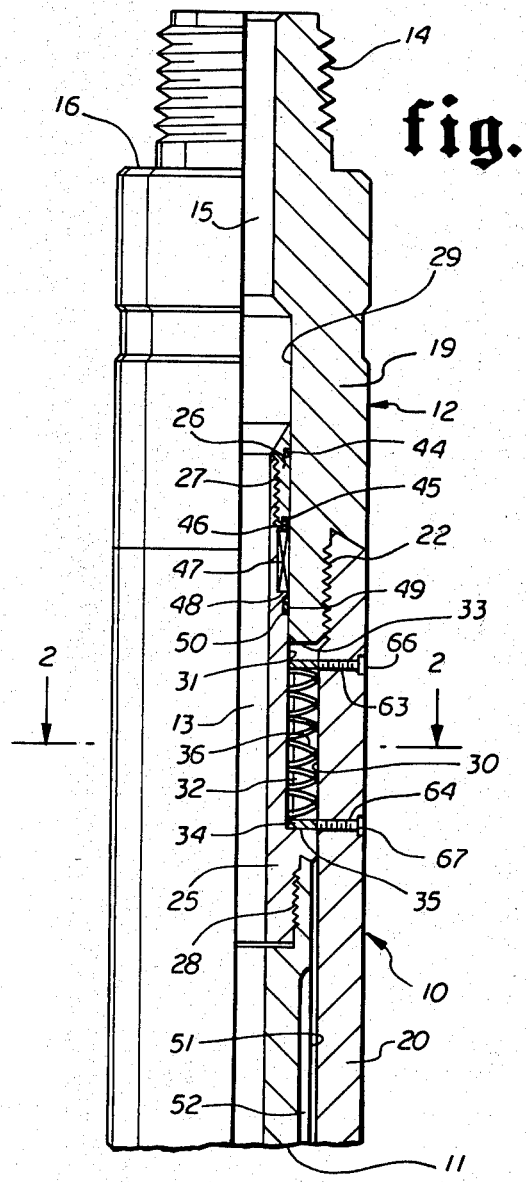
FIGS. 1*a* and 1*b* are broken portions of a shock sub representing a preferred embodiment of this invention and shown in quarter section.
Figure 1B:
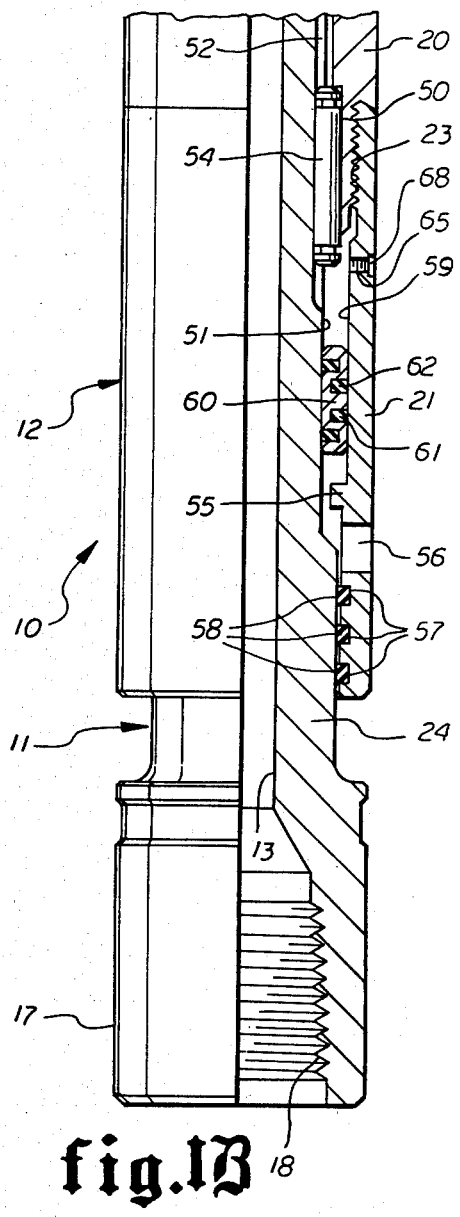

Referring to the drawings by numerals of reference, there is shown a shock sub 10, also called a shock joint or shock absorber, which comprises a mandrel 11 which is positioned for sliding movement in a hollow tubular housing 12. Mandrel 11 is provided with a longitudinal interior passage 13 which extends for the entire length thereof. The upper end of housing 12 has a threaded pin portion 14 having an internal passage 15 communicating with passage 13 in mandrel 11 and providing for the flow of drilling fluid therethrough.

The upper end of housing 12 is provided with an end shoulder 16 adjacent to the base of the threaded pin portion 14. The pin portion 14 is adapted to be connected within the threaded box end portion of a drill string (not shown), which may be a drill collar or a tool joint or the like.

The bottom end 17 of mandrel 11 is somewhat enlarged and is internally threaded as at 18 to receive the threaded pin of a tricone drill bit or the like. The passages 15 and 13 provide for the circulation of the drilling fluid from the drill string through shock sub 10 to circulate past the drill bit and remove cuttings from the bore hole.

Housing 12 is formed in three sections, viz., collar sub 19, drive sleeve 20, and floater barrel 21, which are threadedly connected together as indicated at 22 and 23. Mandrel 11 is likewise formed in three sections, viz., bit sub mandrel 24, mandrel extension 25, and seal retainer nut 26, which are threadedly connected as indicated at 27 and 28.

Collar sub 19 of housing 12 has a smooth bore 29 in which the mandrel extension 25 and seal retainer nut 26 of mandrel 11 have a sliding fit. The drive sleeve 20 of housing 12 has a smooth bore 30 which is enlarged relative to the bore 29 and is spaced from the outer surface 31 of mandrel extension 25 to define a cavity 32. The ends of cavity 32 are defined by shoulder 33 on collar sub 19 and retaining ring 34 which rests on shoulder 35 on mandrel extension 25.

Figure 2:
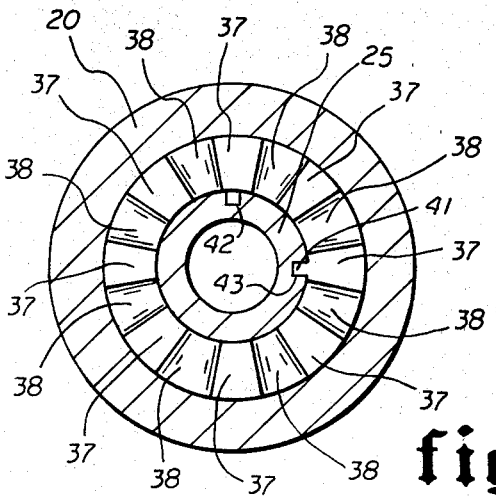
FIG. 2 is a sectional view taken on the line 2—2 of FIG. 1.
Figure 3:
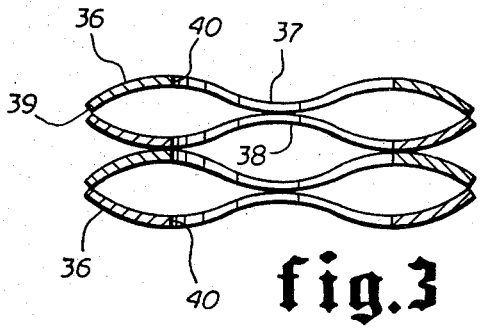
FIG. 3 is a view in vertical section taken through the spring washers which provide for absorbtion of shock in the improved shock sub.

Cavity 32 is filled with a plurality of spring washers 36 which are shown in more detail in FIGS. 2 and 3. Spring washers 36 are formed of a hard spring steel, e.g. spring Nitralloy, and are corrugated in a wave form with alternating troughs 37 and crests 38. The outer surface 39 of washers 36 are of a size having a sliding fit or loosely fitting in the bore 30 of cavity 32. The inner opening 40 of washers 36 is of a size having a smooth sliding fit on mandrel surface 31. Each of the washers 36 is provided with an inwardly extending tab 41 for locating the washers on mandrel extension 25. Mandrel extension 25 is provided with a pair of longitudinally extending slots 42 and 43 which are spaced 90° apart circumferentially of the mandrel surface. Spring washers 36 are assembled on mandrel extension 25 with tabs 41 alternately positioned in slots 42 and 43. This arrangement prevents rotation of the washers 36 and secures them with the troughs 37 resting on the crests 38 of an adjacent washer. This arrangement fixes the washers 36 in this position to maintain a spring configuration, as shown in FIG. 3, and prevents the washers from rotating to a position where the washers can nest.

The upper section or seal retainer nut 26 of mandrel 11 provided with a sealing ring 44, preferably Parker Molythane Poly-Pak, and has holes 45 drilled therein which retain springs 46 which press against sealing ring 47, preferably V-packing, positioned between the lower end of seal retainer nut 26 and shoulder 48 on mandrel extension 25. A hard metal wear ring 49, preferably a Parker wear ring, is positioned in a slot 50 on mandrel extension 25.

The outer surface 51 of bit sub mandrel 24 is provided with spline grooves 52 which match with corresponding grooves 53 in housing drive sleeve 20. Cylindrical bearing members or drive pins 54 are positioned in each of the pairs of matching grooves 52 and 53 and permit sliding longitudinal movement between mandrel 11 and housing 12 but prevent relative rotary movement therebetween so that this shock sub can drive the drill bit and absorb longitudinal shocks.

The lower housing section or floater barrel 21 has an inwardly extending shoulder 55, which limits downward movement of the mandrel, and a slot 56 open to surrounding pressure of the well. The lower end of housing floater barrel 21 is provided with a plurality of grooves 57 in which there are positioned sealing and bearing rings 58, preferably Parker wear rings. The space between the outer surface 51 of bit sub mandrel 24 and the inner surface 59 of housing floater barrel 21 is sealed by a floater or floating bearing and sealing member 60 having slots 61 and bearing and sealing rings 62 supported therein. The apparatus is filled with lubricant, preferably silicone oil, through holes 63 and 64 in housing drive sleeve 20 and hole 65 in housing floater barrel 21. These holes are sealed by threaded plugs 66, 67 and 68, preferably N.P.T. fill plugs.

ASSEMBLY AND SERVICE

The shock joint requires minimal rig service under normal conditions. The following are checks and guidelines that can extend the overall tool life when routinely applied after each trip.

Visually inspect tool body for cracks, excessive wear and tong damage. Check end connections for damage such as pulled threads, galling, cracks, washout and damaged shoulders, etc. If encountered, lay the tool down, check it and repair it before going back into the hole. Connections should be thoroughly lubricated with drill collar compound every trip.

Check barrel connections to insure that a back-off or washout has not occurred. If a connection backoff is detected, lay tool down, disassemble, and thoroughly examine before reassembly and return to service. Check fill plugs and tighten if necessary. Examine tool for excessive amounts of silicone oil in tool bore and around fill plugs. If excessive amounts are detected, tool should be filled with silicone oil and pressure tested to verify seal integrity.

Tool life is dependent on a variety of factors in normal drilling: bottom hole temperature, weight on bit, pump pressure, and formation hardness. While the shock joint has been designed to operate over a broad range of parameters; it is understandable that tool life will vary as those parameters vary. The most accurate method to determine tool life, is to monitor the tool gap between the bit sub mandrel 24 and floater barrel 21. As the shock absorbing springs 36 wear, they shorten in length, allowing bit sub mandrel 24 to enter floater barrel 21, thereby decreasing the gap between the shoulders of the two parts.

By carefully measuring the gap after each trip, one can predict the tool life based on that particular set of drilling parameters. To properly measure the gap, the tool must be under compression. When the shock sub 10 is brought out of the hole, set the weight of two or three drill collars on the tool. With the weight in place, measure the gap between the shoulders and record. Under no circumstances allow the gap to decrease less than two (2) inches, regardless of the number of rotating hours.

Prior to the disassembly of shock sub 10, it should be thoroughly cleaned with a high velocity stream of water to dislodge and remove accumulations of drilling mud and formation cuttings trapped with the tool. Mud vent openings 56 in floater barrel 21 should be of particular interest. Place the hose nozzle in the mud vent openings to remove foreign materials from the mud reservoir between floater barrel 21 and bit sub mandrel 24. Should this area become clogged with these accumulations, it could prevent disassembly of the tool. Other areas of interest are the fill plug openings 63, 64 and 65 and tool bore 13, 15.

DISASSEMBLY PROCEDURE

During the disassembly procedure, packing items may be discarded and held for future evaluation. To aid in disassembly, the tool should be fully compressed. The mandrel 11 should be inserted into floater barrel 21 as much as possible, utilizing the horizontal cylinder of break-out machine.

Clamp drive sleeve 20 of shock sub 10 in vise and break-out tong in collar sub 19. Apply left hand torque, break connection and back off at least 5 turns. This will allow the escape of any high pressure gasses trapped in the tool. Remove fill plugs 66, 67 and 68 from tool and drain silicone oil. Occasionally, fill plugs must be drilled out. When attempting such an operation, care should be taken not to damage threads in the tool barrels. Fill plugs should be discarded and not reused.

Install collar removal sub. Complete break out of connections and remove collar sub 19 utilizing the horizontal cylinder of the break-out machine. Next, loosen seal retainer set screws, break out and remove seal retainer nut 26. Remove and discard packing springs 46 and Parker Molythane poly pak 44. The end of mandrel extension 25 must protrude a minimum of five (5) inches beyond the shoulder of drive sleeve 20. If not, the tool must be compressed further, by pushing the mandrel 11 further into floater barrel 21, with break out machine horizontal cylinder.

Next, remove and discard V-packing elements 47. Remove mandrel extension 25 and the shock spring washers 36 will come out with the mandrel extension. Slide mandrel extension wrench over end of mandrel extension 25, and engage internal keys of wrench with grooves 42 and 43 on extension. Place tong on wrench, and apply left hand torque to break connection between bit sub mandrel 24 and mandrel extension 25. Continue to loosen connection until completely disengaged. Remove wrench and install mandrel extension removal sub. Withdraw mandrel extension 25, with shock spring washers 36, and non-extrusion ring 34 attached, from drive sleeve barrel 20. If extraction by hand is difficult, attach horizontal cylinder of break-out machine to sub and remove mandrel extension 25. Remove and discard mandrel extension poly pak 49.

Clamp drive sleeve 20 in vise and break-out tong on floater barrel 21. Apply left hand torque, break-out and remove floater barrel 21. With floater barrel 21 clamped in vise, install mandrel removal sub in bit sub mandrel 24. Attach the horizontal cylinder of break-out machine to sub; and extract mandrel 11 from floater barrel 21. Remove and discard wear rings 58. With floater barrel 21 clamped in vise, insert floater removal tool, and grasp I.D. of floater 60. Using handles provided on removal tool, extract floater 60 from floater barrel 21 by pulling slowly. Then, remove and discard floater poly paks 62 from floater 60.

CLEANING AND INSPECTION

Clean all parts from the disassembled tool with a high velocity stream of hot water solution, containing industrial grade detergent. If high pressure water is not available, clean tool with solvents and/or degreasing agents. Hardened deposits of foreign material, which can not be removed as described above, should be removed with a steel brush or other suitable tool.

Visually inspect pin and box of each tool part for any evidence of damage to threads or shoulders. Remove any pulled threads with file or grinder, file off any dents, ridges, nicks and completely clear threads all around the diameter. Remove minor nicks and surface blemishes from tool joint shoulders with file or whetstone. Good visual inspection with usually reveal an unacceptable tool joint. Conditions such as a washout, heavily flattened shoulders or threads are defined as unacceptable. If any tool joint is found to evidence these conditions, the part must be replaced. In certain instances, it is possible to re-cut end connections if extensive damage has not occurred.

Tool joints should be gauged, and give a thorough dimensional inspection periodically. Magnetic particle (Magnaflux) inspections should be made on a regular basis; not to exceed every other tool refurbishment. Visually inspect and feel seal surfaces on the mandrel 11. Examine for grooves, ridges, pitting and flaking or chrome plating; a smooth and flat surface is required to obtain satisfactory seal and packing life. When surface conditions are not readily evident, place steel straight edge on top and look for an uneven surface or streaks of light at the touching edge. If surface is not smooth and flat, the mandrel must be repaired or replaced. Repair is possible only if adequate shop facilities are available and excessive damage has not occurred.

Visually inspect internal and external drive pin grooves 52 and 53 for excessive wear. Also inspect individual drive pins 54, for unusual wear and damage. Any drive pin 54, which is not smooth and round should be replaced. Visually inspect and feel chrome plated I.D. of collar sub 19 for grooves, ridges, pitting and flaking of chrome plating. If evidence of excessive surface damage is detected, the part must be repaired or replaced.

All remaining surfaces of tool components should be carefully examined for unusual wear or damage. Remove any burrs, nicks, or ridges from all mating and working surfaces. With all parts thoroughly cleaned, inspected, and redressed if necessary, re-assembly of the shock joint may be attempted.

REASSEMBLY/ASSEMBLY

All parts should be clean, and free of excess dirt and oil residue. All parts should be inspected to insure they are free of mechanical defects, such as cracks, butts, and damaged threads and shoulders. All mating parts should be thoroughly lubricated for ease of assembly. Threaded connections should be lubricated with an approved drill collar lubricant, which usually consists of 40–60% metalized particles suspended in a soft grease base. It is recommended that all other parts be lubricated with a non-petroleum base lubricant. DC 111 or other silicone based fluids or greases are excellent for this purpose.

Inspect all packing components; poly paks, o-rings, wear rings, and v-packing for possible damage. Nicked or damaged packing can cause washouts, or in extreme cases, tool failure. During any assembly step, where tool packing is involved, care should be taken not to damage said packing during the actual assembly procedure. Whenever the functional integrity of any packing element is in doubt, replace it. Always lubricate packing completely with a silicone base lubricant prior to assembly.

After completion of the assembly of the shock joint or sub 10, each tool must be filled with silicone oil and pressure tested to verify seal integrity. Install fill plug 66 in the top fill port 63 of the tool. Install a high pressure coupling in bottom fill port 65. Engage one end of high pressure hose assembly to the high pressure coupling of outlet valve. Attach air supply, 100 to 150 PSI, to coupling of inlet valve; switch outlet valve to divert air supply through hose into tool. Open inlet valve and raise air pressure to a minimum of 100 PSI. When the pressure has reached its highest point and stabilizes, close inlet valve. Observe pressure on inlet pressure gauge for approximately 10 minutes. If the air pressure test shows a steady escape of pressure, shock joint or sub 10 should be disassembled and examined to isolate and correct the sealing problems. If pressure remains fairly stable during this period, it can be assumed that all packing and seals are properly sealed.

Disengage hose assembly from coupling of outlet valve and engage with coupling of outlet valve. Switch outlet valve to divert air supply into silicone oil pump. Switch outlet valve to divert oil flow through hose into tool. Remove fill plug 66 from top fill port 63, and open inlet valve. Pump silicone oil into tool, until the oil flows from the top fill port 63, approximately 15 to 20 minutes. Allow a small amount of oil to overflow to insure that the majority of the air bubbles have escaped.

Close inlet valve to cease oil flow and re-install fill plug 66 in top fill port 63. Open inlet valve to reestablish flow and pump until the pressure on the outlet pressure gauge reaches and stabilizes 4000 PSI. Close outlet valve and observe pressure for approximately 15 minutes. If the test reveals a steady escape of pressure, the shock joint or sub 10 should be disassembled and examined to isolate and correct sealing problems. If pressure remains stable, tool is ready for service. Slightly open outlet valve to release system pressure. Note that the hydraulic section of pump unit is under high pressure; do not disengage high pressure hose assembly before release of pressure with outlet valve. Remove high pressure coupling from bottom fill port 65 and install fill plug 68. Check all fill plugs and tighten if required.

After assembly and testing are complete, the following make-ready procedures should be performed to protect the tool from damage and corrosion until actual use. Clean oil residue from tool barrel 12. Lubricate pin and box of end connections with drill collar compounds and install thread protectors.

OPERATION

The shock sub described above is a shock absorbing tool which is placed in the drill collar string to absorb vibration and loads produced by the bit during drilling operations. These vibrations can cause premature bit failure, damage to the components and their connections and can also cause damage to the derrick and surface equipment at shallower depths. The use of a shock sub can result in significant cost savings by isolating the vibration and bit bounce. The shock sub dampening action will increase bit life and permit the use of optimum bit weights and rotary speeds. This allows the rate of penetration to increase, resulting in a decrease in the cost per foot of hole drilled. This elimination of vibration will also result in decreased rig maintenance costs, by reducing wear and tear on the surface and subsurface equipment.

A specially positioned series of wave springs 36 comprise the shock absorbing element for the shock sub. The wave springs are secured on the mandrel by alternating the securing tabs 41 in slots 42 and 43 to insure that the crests of the waves on one spring rest on the troughs of the adjacent spring, as is shown in FIGS. 2 and 3 and to a limited extent in FIG. 1*a*. The characteristics of this system of spring washers are substantially the same as that of silicone fluid which is often used in sophisticated industrial shock absorbers, yet does not have the disadvantage of fluid loss through the seals.

The assembly connections are oil field proven tapered threads, with angled locking shoulder for maximum torsional strength and rigidity. The tool is preferably machined from 4240/4340 aircraft quality heat treated steels with high compression strength bearing pads 49, 58 and 62 located throughout the tool at selected positions giving it maximum rigidity with a minimum of metal to metal wear.

Drilling torque is transmitted through replaceable drive pins or bearing members 54 which provide for low bearing pressure. The working mechanism including springs 36 and bearing members 54 is sealed in silicone oil for maximum service life; and piston or floater 60 at one end of the tool compensates for thermal expansion of the silicone oil and balances annular mud pressure with the oil reservoir in the tool.

The shock sub is preferably run directly above the bit during the normal drilling operations. When the sub is run directly above the bit, the oscillating mass that the shock absorbing elements, i.e. wave springs 36, must overcome is limited to the weight of the bit and mandrel only. This allows the tool to dampen bit acceleration effectively and hold it on the bottom, while reducing impact on the upper part of the drill string. Under normal conditions, any desired weight, rotary speed, and pump pressure can be used and no special operating techniques are required.

While this invention has been described fully and completey with special emphasis on a single, preferred embodiment, it should be understood that within the scope of the appended claims, this invention may be practiced otherwise than as specifically described.

I claim:

1. A shock sub for use in a drill string for absorbing longitudinal and impact loads comprising a tubular housing adapted for connection to one part of a drill string, a tubular mandrel extending longitudinally into said housing for longitudinal sliding movement therein and having an end portion adapted for connection to another part of a drill string, said housing having a smooth cylindrical inner wall surface portion with an inner diameter larger than the outer diameter of said mandrel, said mandrel having a cylindrical surface portion defining an annular cavity inside said housing smooth cylindrical inner wall surface portion, said mandrel having two longitudinally extending slots, positioned 90° apart circumferentially and extending substantially the entire length of said annular cavity, a plurality of annular spring washers positioned in said annular cavity of a size having a circular opening with a sliding fit on said mandrel and circular exterior with a sliding fit inside said housing smooth cylindrical inner wall surface portion, each of said spring washers being corrugated circumferentially in a wave configuration and having an internally extending tab of a size fitting said mandrel slots, said spring washers being assembled on said mandrel with alternate ones having the tabs thereof fitting in one of said mandrel slots and the remaining alternate ones having the tabs thereof fitting in another mandrel slot positioned 90° from said one slot to secure said washers in circumferentially fixed relation with the troughs of one washer resting on the crests of the next adjacent washer, and means interconnecting said mandrel and said housing permitting longitudinal sliding movement therebetween and preventing relative rotary movement comprising a plurality of longitudinal grooves in the bore of said housing, a plurality of matching grooves in the surface of said mandrel, and a plurality of cylindrical bearing members positioned between said matching grooves in said housing and in said mandrel.

2. A shock sub according to claim 1 in which said washers each have wave corrugations with symmetrical alternating crests and troughs circumferentially thereof, and said assembly of alternate washers on said mandrel by said washer tabs and mandrel grooves being effective to align said washers with the troughs of one washer resting on the crests of an adjacent washer.

3. A shock sub according to claim 1 in which said housing has an enlarged bore comprising said smooth cylindrical inner wall surface portion with an internally extending circumferential shoulder, said mandrel has a portion of reduced diameter with a circumferential shoulder, said shoulders, said housing enlarged bore, and said mandrel portion of reduced diameter defining said cavity, and said washers being positioned in said cavity abutting said shoulders and extending the entire length of said cavity.

4. A shock sub according to claim 1 in which said housing has an enlarged bore adjacent to said smooth cylindrical inner wall surface portion and said mandrel has a portion of reduced diameter cooperating when assembled to define a second cavity adjacent said first-named cavity to contain lubricant for said shock sub, an annular bearing and sealing member positioned at one end of said second cavity to seal against leakage of lubricant and support said housing and mandrel for relative sliding movement, and bearing and sealing means positioned adjacent the end of said first-named cavity opposite said second cavity permitting lubricant to fill both cavities and supporting said housing and mandrel for relative sliding movement.

5. A shock sub according to claim 1 in which one end of said housing into which said mandrel extends includes an internal shoulder limiting downward movement of said mandrel when said housing is lifted.

6. A shock sub according to claim 5 in which said housing comprises a plurality of separate sections threadedly securable together for assembly and disassembly, said internal shoulder being on the lowermost housing section, and said mandrel comprising a plurality of separate sections threadedly securable together for assembly and disassembly.

* * * * *